US005081795A

United States Patent [19]

Tanaka et al.

[11] Patent Number: 5,081,795

[45] Date of Patent: Jan. 21, 1992

[54] POLISHING APPARATUS

[75] Inventors: Kouichi Tanaka, Takasaki; Isao Uchiyama, Nishigo, both of Japan

[73] Assignee: Shin-Etsu Handotai Co., Ltd., Tokyo, Japan

[21] Appl. No.: 643,094

[22] Filed: Jan. 22, 1991

Related U.S. Application Data

[63] Continuation of Ser. No. 418,263, Oct. 6, 1989, abandoned.

[30] Foreign Application Priority Data

Oct. 6, 1988 [JP] Japan ..... 63-250893

[51] Int. Cl.[5] ..... B24B 5/00

[52] U.S. Cl. ..... 51/131.1; 51/131.4; 51/216 LP 237 R

[58] Field of Search ..... 51/131.1, 131.3, 131.4, 51/216 LP, 129, 236, 237 B, 237 R

[56] References Cited

U.S. PATENT DOCUMENTS

| | | | |
|---|---|---|---|
| 3,886,693 | 6/1975 | Brück | 51/237 R |
| 4,459,785 | 7/1984 | Zimmer | 51/131.3 |
| 4,897,966 | 2/1990 | Takahashi | 51/131.3 |

*Primary Examiner*—M. Rachuba

*Attorney, Agent, or Firm*—Cushman, Darby & Cushman

[57] ABSTRACT

A polishing apparatus for polishing an object to be polished at a high flatness includes at least one plate with at least one object to be polished secured at an underside thereof, a head section surrounding the plate with a predetermined gap therebetween, a pressure applying device for applying a pressing force to the top of the plate, and a holding device for holding the plate in the plane of the polishing movement of the object to be polished. The pressure applying device and the holding device are both disposed in an inner space of the head section, the latter being movable perpendicular to the plane of the polishing movement. The attaching position of the holding device on the outer surface of the plate is set substantially at the same height as or at a position lower than the attaching position of the holding device on the inner surface of the head section. The intersecting point of the imaginary lines through the fixing positions of the holding device on the head section and those corresponding to them on the plate substantially lies on or at a position lower than the polishing surface of the object to be polished.

10 Claims, 7 Drawing Sheets

POLISHING APPARATUS

This is a continuation of application No. 07/418,263, filed on Oct. 6, 1989, which was abandoned upon the filing hereof of application No. 07/643,094.

BACKGROUND OF THE INVENTION

1. Field of the Invention

The present invention relates to a polishing apparatus for polishing the surface of a plate-shaped object. The invention utilizes relative movement between the object and a polishing cloth, while pressing the two together. More particularly, the invention is directed to a polishing apparatus for polishing silicon wafers, or other thin semiconductor disks, with high accuracy.

2. Description of the Related Art

Recently, there has been remarkable progress in miniaturization and high integration of semiconductor devices. The technological progress has led to the current age of VLSI circuits having more than 100,000 devices per chip. With this progress, development of the optolithographic technology for drawing an IC pattern on a thin semiconductor plate has rapidly been promoted to such a level that it can draw an IC pattern having a much narrower line width: a 1-μm line width for a 1M-bit dynamic RAM and a 0.8-μm line width for a 4M-bit dynamic RAM, for example. Such a technology is employed in, for example, a laser stepper apparatus of a projection exposure type.

Such an exposure optical system needs a greater number of apertures in order to realize the IC patterns having a very narrow line width. Therefore, it is inevitable to decrease the depth of the focus. This requires a higher accuracy in the flatness of the surface of a thin semiconductor disk, onto which an IC pattern is projected.

An example of a polishing apparatus for such a thin semiconductor disk is illustrated in FIG. 9. This polishing apparatus comprises a turn table (hereinafter referred to as a surface table 2) having a polishing cloth 1 stuck on its top surface and being rotatable by an external driving force, a plate 91 disposed above the polishing cloth-stuck surface (hereinafter referred to as a polishing surface 1A) and having one or more thin semiconductor plates 3 adhered or stuck to its bottom surface, and a mount head (hereinafter referred to as a head section 92) for applying a pressurizing force from the top of the plate 91 by using a pressing shaft 93. The polishing apparatus causes a polishing or rubbing movement between the underside 95 of each thin semiconductor disk 3 and the polishing cloth 1 (polishing material) while dispersing the polishing agent (wet type or dry type) containing abrasive grains, such as $SiO_2$ or $Fe_2O_3$, on the polishing cloth 1 through a polishing agent dispersion unit 94 or the like, whereby the surface of the thin semiconductor disk 3 is polished at a high accuracy based on a so-called mechanochemical polishing method (a combination of mechanical polishing and chemical polishing). This polishing apparatus will be hereinafter referred to as the first prior art.

According to the above apparatus, however, due to frictional resistance between the underside 95 of each thin semiconductor disk 3 and the polishing cloth 1, the plate 91 having the thin disks 3 secured thereto is tilted downward at its leading edge and causes a relative increase in pressurizing force on the leading edge of the disk 3 from the polishing cloth 1. Consequently, even if the leading edge of the plate 91 is shifted along the periphery, resulting from compulsory or natural rotations about its own axis, while the plate 91 is pressed on the rotational surface table 2, so that the plate 91 rotates in a relative planetary motions with the rotational surface table 2, the superficial stock removal of thin semiconductor disks 3 does not become uniform over each wafer so that high flatness of the surface of the polished thin plates 3 cannot be realized.

As a solution to this shortcoming, there was proposed a structure as shown in FIG. 8. As illustrated in this diagram, a hollow section 96 defined between a head section 82 and a partition film 89 is filled with a fluid 88 so that the partition film 89 comes in close contact with the top of a plate 81. A ring-shaped retainer 87 is fit in a ring-shaped gap formed around the plate 81 to securely support the peripheral portion of the partition film 89. This structure can restrict movement between the plate 81 and head section 82 in a plane parallel to the polishing surface 1A. This polishing apparatus, which is disclosed in, for example, Published Unexamined Japanese Patent Application No. 63-52967, will be hereinafter referred to as the second prior art.

According to the second prior art, it may appear possible to overcome the problem identified in the first prior art. Since, in theory, the fluid 88 evenly presses the top of the plate 81 through the partition film 89, a pressure applied between the thin semiconductor disks or wafers 3 and the polishing cloth 1 becomes uniform. On the contrary, the solution cannot be realized for the following reason. During polishing, a frictional force S generated between each wafer 3 and the polishing cloth 1 acts on the plate 81. This force S acts in the rotational direction of the surface table 2 on the polishing surface 1A. There also exists a reaction force R against the frictional force, which acts on the plate 81 from the retainer 87 at the contact portion therebetween. No consideration whatsoever is paid to the direction of action of this reaction force R acting in a plane parallel to the polishing surface 1A from a structural point of view.

Since the frictional force S and reaction force R do not exist in the same plane, a third force originating from the contacting pressure between the polishing cloth and wafers should be involved in order to balance the force acting on the plate 81. According to the second prior art, however, since the direction of action of the reaction force R is parallel to the polishing surface 1A, a rotation moment is generated on the plate 81 to tilt the plate 81. This produces non-uniform contacting pressure or pressurizing force between the polishing cloth 1 and wafers 3, so that the wafer surface cannot be polished with a high flatness.

Both of the prior art apparatuses are so designed that a plurality of thin semiconductor plates 3 are secured to the bottom of a single plate 81 or 91. Due to an unavoidable slight variation in thickness of the thin disks 3, the parallelism between the plate 81 or 91 and the polishing surface 1A may not be maintained at high accuracy. Accordingly, slight tilting of the plate 81 or 91 is likely to result in non-uniform pressure acting on the thin disks 3, so that high flatness of the polished surface of each thin semiconductor plate 3 cannot be realized.

As a solution to this shortcoming, the applicant previously proposed a structure as shown in FIG. 7. As illustrated in this diagram, a single thin disk 3 is secured to a plate 71 and this plate 71 is supported by a so-called spherical bearing 79 disposed between the plate 71 and a head section 72. That portion of the spherical bearing 79 which is on the side of the top of the plate 71 is shaped to have a convex surface 71*a* and that portion of the bearing 79 which is on the side of the bottom of the head section 72 is shaped to have a concave surface 72*a*. The operational center (the center of the supporting force P) of the plate 71 or the center P of the spherical bearing 79 is located on the polishing surface 1A. This polishing apparatus, which is disclosed in, for example, Published Unexamined Japanese Patent Application No. 63-62668, will be hereinafter referred to as the third prior art.

According to the third prior art, the operational center P of the pressing force coincides with the polishing surface 1A and uniform load can be applied to the plate 71 by the spherical bearing 79. Therefore, the force S from the polishing cloth originating from the aforementioned frictional resistance acts in the same plane where the operational center of the pressing force exists. This should prevent the plate 71 from tilting and can produce substantially uniform polishing pressure on the underside of the thin disk 3 secured to the underside of the plate 71, thus ensuring surface polishing at a high flatness.

The structure of the mechanical supporting means of the spherical bearing 79 wherein the convex surface 71*a* and the concave surface 72*a* are in surface contact with each other and the structure wherein a pressure is applied on the plate 71 by way of the pressing shaft 73 unavoidably cause the frictional resistance between the plate 71 and the head section 72 to be great. As a result, even if a slight displacement of the surface table 2 occurs while the surface table 2 is rotating, the plate 71 cannot closely follow the surface table 2, thus making it difficult to perform surface polishing with a high flatness.

SUMMARY OF THE INVENTION

Accordingly, it is the primary object of the present invention to provide a polishing apparatus which can execute a polishing work without causing the plate 71 to undesirably tilt and can easily follow even slight surface displacement when the surface table 2 rotates to correct the position of the plate 71 by way of a follow-up motion, thereby ensuring surface polishing of a thin semiconductor plate 3 with a high flatness.

It is another object of this invention to provide a polishing apparatus which can polish a plurality of thin plates 3 and can execute a polishing work while maintaining high parallelism irrespective of a possible change in thickness of thin plates per lot.

As for means for solving the problems;

A) The invention described in the appended claims 1 to 6 (hereinafter referred to as the first invention) relates to a polishing apparatus for achieving the first object and is characterized by the following four points.

(1) A plate having at least one plate-shaped object to be polished secured at the underside thereof is separated by a predetermined gap from a head section which surrounds the periphery of the plate. In other words, the plate is in non-contact with the head section by way of a predetermined gap therebetween.

(2) Pressure applying means for applying a pressure force toward the object to be polished from the top of the plate is provided in the gap.

This pressure applying means may be realized by utilizing a dead load such as a weight, a diaphragm or bellows to apply fluid pressure to the entire top surface of the plate or to the load center on the top of the plate. Alternatively, the pressure applying means may be provided with a pressure adjusting mechanism to ensure arbitrary pressure adjustment.

(3) Holding means, which is movable in the pressure applying directions and capable of holding the plate to perfectly follow the upper surface of the polishing cloth attached over the rotational surface table, is also provided in the gap.

In other words, a non-shrinkable and flexible member which can achieve the above function is provided between the plate and head section to link them and serve as holding means. In this case, "holding the plate to perfectly follow the upper surface of the polishing cloth" means that the plate can be held in place without tilting in any direction within a plane parallel to the plane of the polishing movement or the plane thereof itself.

The holding means may be formed integral with the plate by a thin film member in such a way as to surround the entire periphery of the plate. Alternatively, the holding means may be formed by attaching non-contractible and flexible members of a thread-like shape on the periphery of the plate at proper intervals at equal angles in the circumferential direction.

Further, the pressure applying means and holding means may be constituted by separate members or may be constituted, as one serving as both means, by one member or a plurality of members.

(4) The position of the holding means attached to the outer surface of the plate is set substantially at the same height as or at a point lower than the position of the holding means attached to the inner surface of the head section. More preferably, the apex P of an imaginary cone containing the holding means or the intersecting point P formed by imaginary lines extending from the attaching positions of the holding means on the head section and the plate substantially lies on or lower than a polishing surface of the object to be polished.

B) The invention described in the appended claims 7 and 8 (hereinafter referred to as the second invention) relates to a polishing apparatus for achieving the second object and is characterized by the following four points.

(1) A plurality of plates each capable of having one plate-shaped object to be polished secured to the underside thereof, are disposed at predetermined position.

(2) One support member, which surrounds those plates with predetermined gaps therebetween.

(3) The support member and the individual plate are held by non-shrinkable and flexible members. Preferably, the position of each flexible member attached to the outer surface of the associated plate is set substantially at the same height as or at a point lower than the attaching position of that flexible member on the inner surface of the support member.

(4) It is preferable that pressure applying means for applying a pressing force toward an object to be polished from the top of the associated plate be provided in the associated gap, as per the first invention.

According to the first invention, since a plate 11 is coupled to a head section 12 by holding means 14 whose position is restricted in a direction parallel to the plane of a polishing movement of an object 3 to be polished as shown in FIG. 1*a*, holding force on the side of the head section 12 and the rotation thereof can be smoothly transmitted to the plate 11 to carry out a given polishing work.

Since the plate 11 is designed to be movable in any other direction (to be specific, mainly vertical directions) than the direction of the plane of the polishing movement and the plate 11 is separated by a gap 15 from the head section 12, a frictional resistance is not produced between the plate 11 and the head section 12. Even if a slight surface displacement occurs when the surface table 2 rotates, therefore, the plate 11 can easily follow up accordingly so as to cause the polishing surface of the object 3 to coincide with the polishing surface 1A. It is therefore possible to realize high parallelism between the plate and the polishing surface 1A during a polishing work.

Further, as also shown in FIG. 1(*a*), the attaching position 14*a* of the holding means 14 on the outer surface of the plate 11 is set substantially at the same height as or at a point lower than the attaching position 14*b* of the holding means 14 on the inner surface of the head section 12. Therefore, the intersecting point P (or the apex of an imaginary cone) formed by imaginary lines extending from the attaching positions of the holding means 14 on the head section 12 and the plate 11, i.e., the operational center P of the holding force described in "Description of the Related Art" with reference to FIG. 7, substantially lies on or lower than the polishing surface 1A of the object 3 to be polished.

If the center P of the holding force for holding the plate 11 at a predetermined position against the force S generated on, and acting from, the polishing surface 1A lies on the same plane as the polishing surface 1A, as shown in FIG. 2, the force S and the holding force cancel out each other so that high parallelism of the plate 11 with respect to the polishing surface 1A can be maintained during rotation of the surface table 2 without generating a moment to tilt the plate 11.

If the center P of the holding force lies below the polishing surface 1A, as shown in FIG. 2B, there would be a force acting in the direction to lift the leading end of the plate 11 so that the object or thin plate 3 tilts backwards. In this case, since a minute wedge-shaped space is formed on that side of the thin plate 3 where a polishing agent is introduced, the polishing agent can easily cover the entire surface of the thin plate 3, thus ensuring more uniform distribution of the polished work as compared with the previous case where high parallelism between the plate and polishing surface is maintained.

According to the second invention, a plurality of objects 3 to be polished are respectively secured to separate plates 51, not to a single plate, and these plates are held by one support member 56 through the respective non-shrinkable and flexible members 54, as shown in FIG. 6(A). Therefore, the positions of the individual plates 51 can be independently adjusted in accordance with the relative polishing movement of the head section 52 to the polishing surface 1A. This ensures a polishing work of a plurality of objects 3 in a single batch process.

Although the foregoing description of the latter embodiment mentions that one thin plate is secured to each plate for descriptive simplicity, a plurality of thin plates may be secured to each plate.

Since, according to the second invention, the positions of the individual plates 51 accommodate in a single head 52 are independently adjusted and the surface accuracy of each plate can be held high, this invention is also applied to a mass-producing system of its kind.

Since the plates 51 are supported by a corresponding number of flexible members 54 whose positions are restricted only in the respective sliding directions, the plates 51 can be vertically movable. Even if there is a change in thickness of the individual thin plates 3, therefore, a polishing work can be executed while maintaining high parallelism between the plates 51 and the polishing surface 1A irrespective of said condition.

In this case, the same effect as obtained by the first invention can be produced by setting the attaching position of each flexible member 54 on the outer surface of the associated plate 51 substantially at the same height as or at a point lower than the attaching position of the flexible member 54 on the inner surface of the support member 56.

DESCRIPTION OF THE PREFERRED EMBODIMENTS

Preferred embodiments of the present invention will now be described in detail referring to the accompanying drawings. The scope of the present invention will be in no way limited to the sizes of constituting components, the materials thereof, the shapes thereof, the relative arrangement thereof, etc., and are disclosed simply as examples in the following description of the embodiments unless otherwise specified.

Figure 1A:
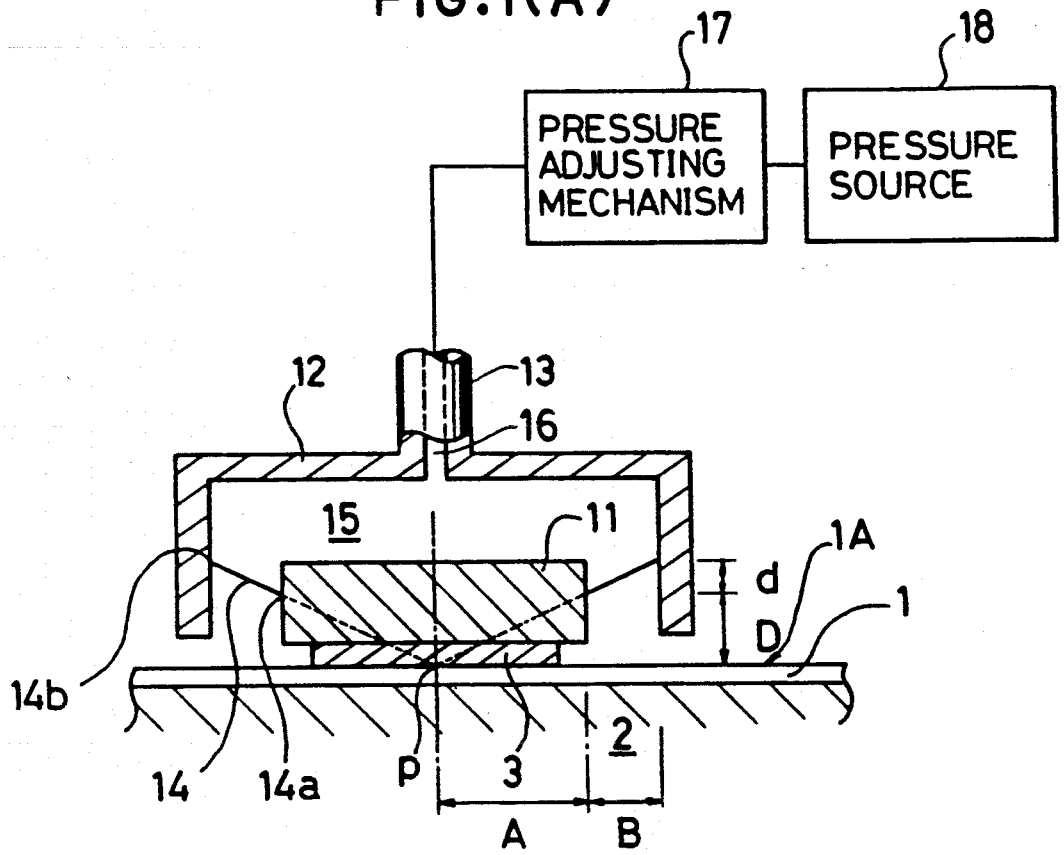
FIGS. 1A and 1B are a front cross-section view and a bottom view of a fundamental embodiment of the first invention, respectively.
Figure 1B:
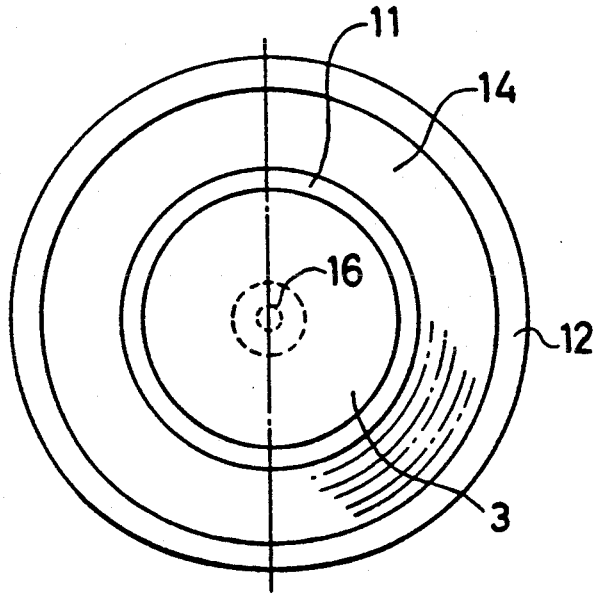

FIGS. 1(A) and 1(B) illustrate the structure of the essential portions of a polishing apparatus according to one embodiment of the first invention. Reference numeral 2 denotes a surface table having a polishing cloth 1 stuck on the top thereof, and reference numeral 11 denotes a disk-shaped plate, which is formed of stainless steel, ceramics or other hard materials and has its underside formed in a smooth plane so that a single thin semiconductor disk 3 is concentrically secured to the underside.

The outer surface of the plate 11 excluding its underside is covered by a head section 12 by way of a predetermined space 15. The head section 12 has a cylindrical cap shape open at the bottom defining the space 15 having a circular cross section greater than the plate 11. A center hole 16 is bored in a rotational shaft 13 projecting from the center of the top of the head section 12. A pressure source 18 is rendered to communicate with the center hole 16 via a pressure adjusting mechanism 17, so that air with controlled pressure can be introduced in the space 15.

The outer wall of the plate 11 and the inner wall of the head section 12 are continually coupled to a non-shrinkable and flexible, ring-shaped thin member 14, thereby sealing the space 15 above the thin member 14 airtight. The attaching position 14*a* of the thin member 14 is set substantially at the same height as or at a point lower than the attaching position 14*b* thereof, so that the apex P of an imaginary cone including the thin member 14 lies on the polishing surface 1A of the thin semiconductor plate 3 or slightly lower than the polishing surface 1A.

The thin member 14 may be formed by a rubber layered sheet having a steel mesh, for example, in a sandwiched manner, or an essentially non-shrinkable but still flexible resin layered sheet or the like having a polyimide resin film with a very low shrinkability layered in a sandwiched manner.

Figure 2A:
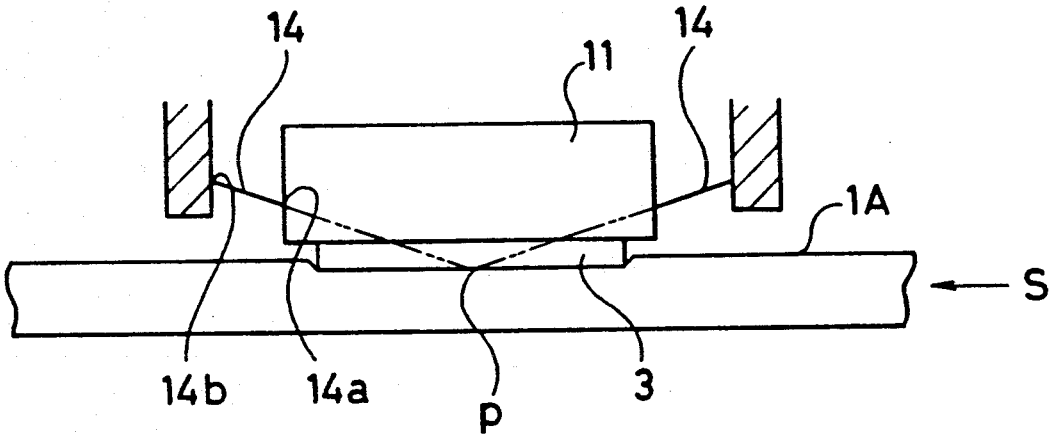
FIG. 2 is an operational diagram of the embodiment.
Figure 2B:
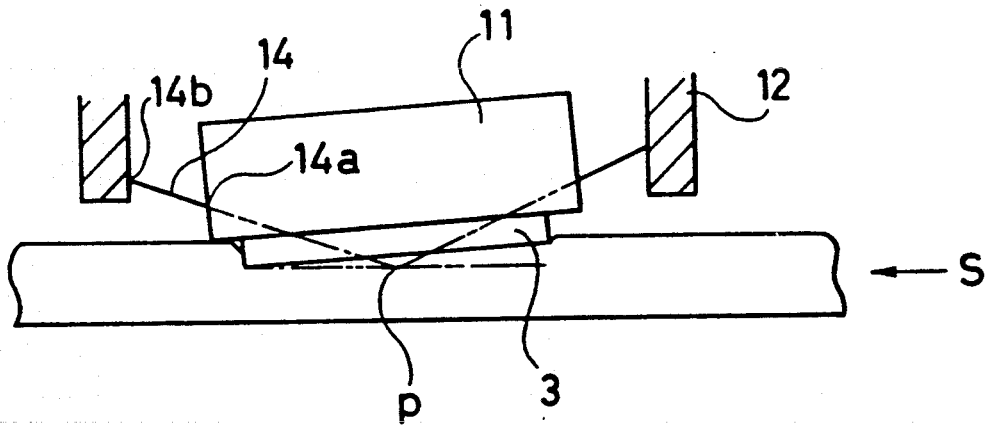

Accordingly to this embodiment, in a case where the head section 12 causes a relative planetary motion on the surface table 2 to carry out a polishing work while pressure-controlled air is being introduced in the space 15 from the center hole 16 to apply uniform pressure over the entire surface of the plate 11, the holding force and the force S from the polishing cloth originating from the frictional resistance produced between the thin plate 3 and polishing surface 1A can cancel out each other since the apex P of the imaginary cone including the thin member 14 is on or slightly lower than the polishing surface 1A, thereby preventing the plate 11 from tilting at the leading edge (see FIG. 2A). According to this embodiment, since an air pressure is applied directly to the thin member 14, the thin member 14 may be deformed after a long usage or it may be difficult to couple the thin member 14 airtight to both of the plate 11 and the head section 12.

Figure 3:
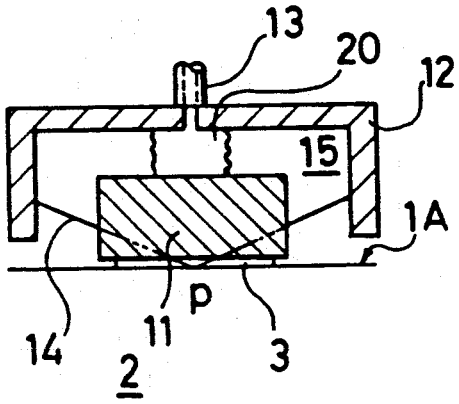
FIGS. 3 through 5 are front cross-sectional views illustrating other embodiments.
Figure 5:
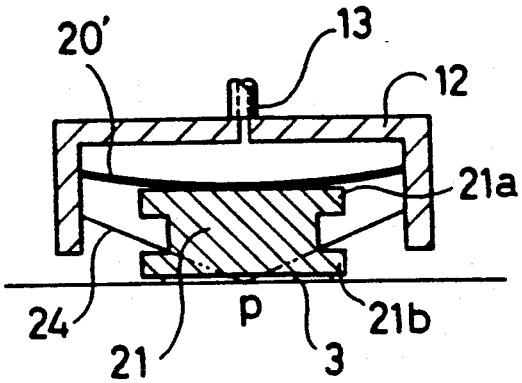

FIGS. 3 and 5 illustrate the structures to overcome the above problem. Bellows 20 serving as pressure applying means is disposed within space above the top of the plate 11 and the thin member 14 or 24 is used exclusively as the holding means.

In either embodiment described above, the accuracy in the intersecting point P formed by the imaginary extension lines of the cross section of the thin layer 14 is expressed by the following equation:

$$D=(A/B)d$$

where

A: horizontal distance between the imaginary intersecting point P and the attaching position of the thin member 14 on the plate 11, B: horizontal distance between the attaching positions of the thin member 14 on the plate 11 and the head section 12, D: vertical distance between the imaginary intersecting point P and the attaching position of the thin layer on the plate 11, and d: vertical distance between the attaching positions of the thin member 14 on the plate 11 and the head section 12.

In a case where the thin member is connected to the outer wall of the plate 11 as in the above embodiments, therefore, the term, (A/B), cannot be made smaller. This would result in enlargement of the polishing apparatus.

Figure 4:
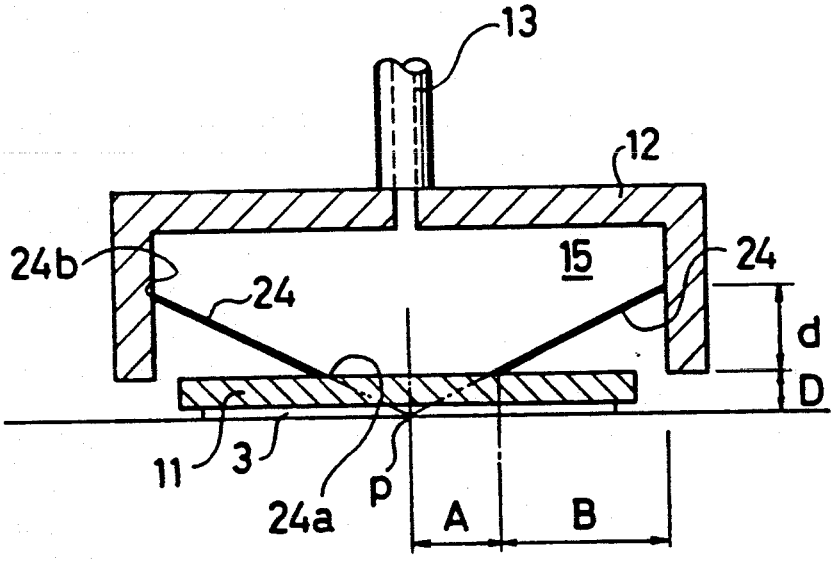

FIG. 4 illustrates the structure to overcome this problem. The attaching position 24*a* of a thin layer 24 on the outer surface of the plate 11 is set closer to the center of the plate 11 than the periphery thereof. This structure can set the term, (A/B), smaller and leads to a compacter polishing apparatus.

With the above structure, a pressing force cannot be applied over the entire top surface of the plate 11. This problem can be solved by employing the structure as shown in FIG. 5. In this structure, a thick plate 21 has a smaller diameter around its middle than at the top portion 21*a* and the bottom portion 21*b*, both the top and the bottom portions are the same in diameter, and a diaphragm 20' for exerting a pressing force to the plate 21 and the thin member 24 serving as holding means are respectively attached to the upside of the top portion 21*a* and the upside of the bottom portion 21*b* of the plate 21.

Since all the above-described embodiments are designed to polish a single thin disk, the productivity is not high.

Figure 6A:
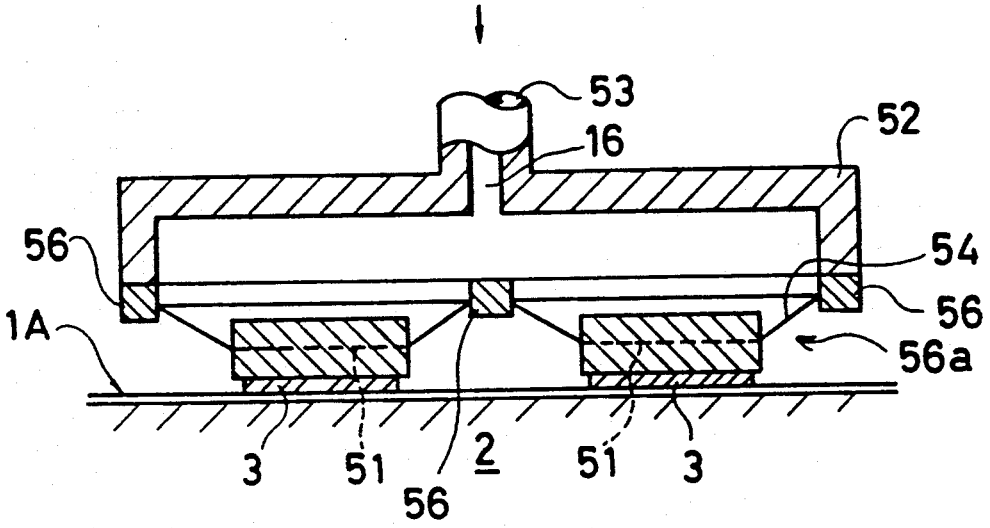
FIGS. 6A and 6B are a front cross-sectional view and a perspective bottom view of a fundamental embodiment of the second invention, respectively.
Figure 6B:
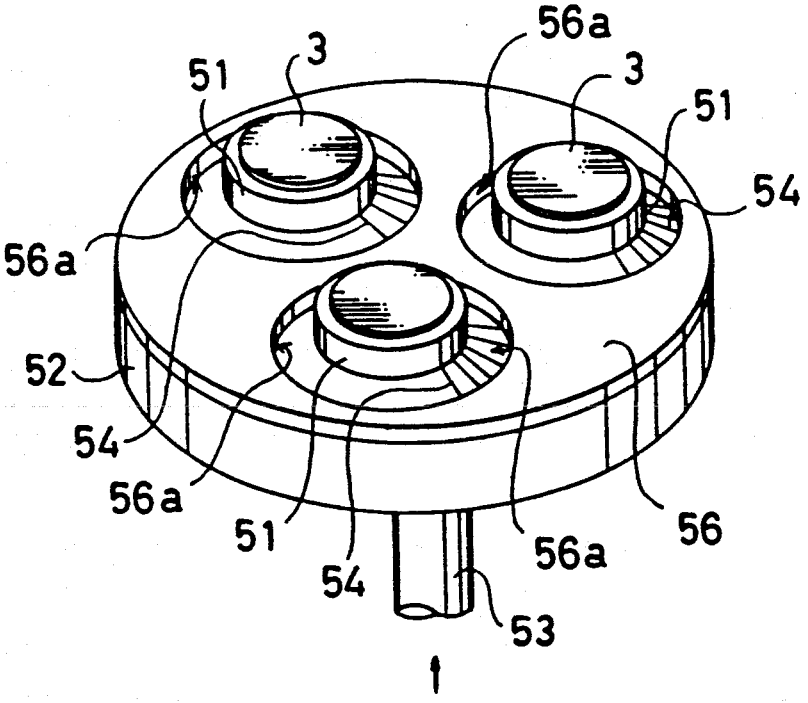
Figure 7:
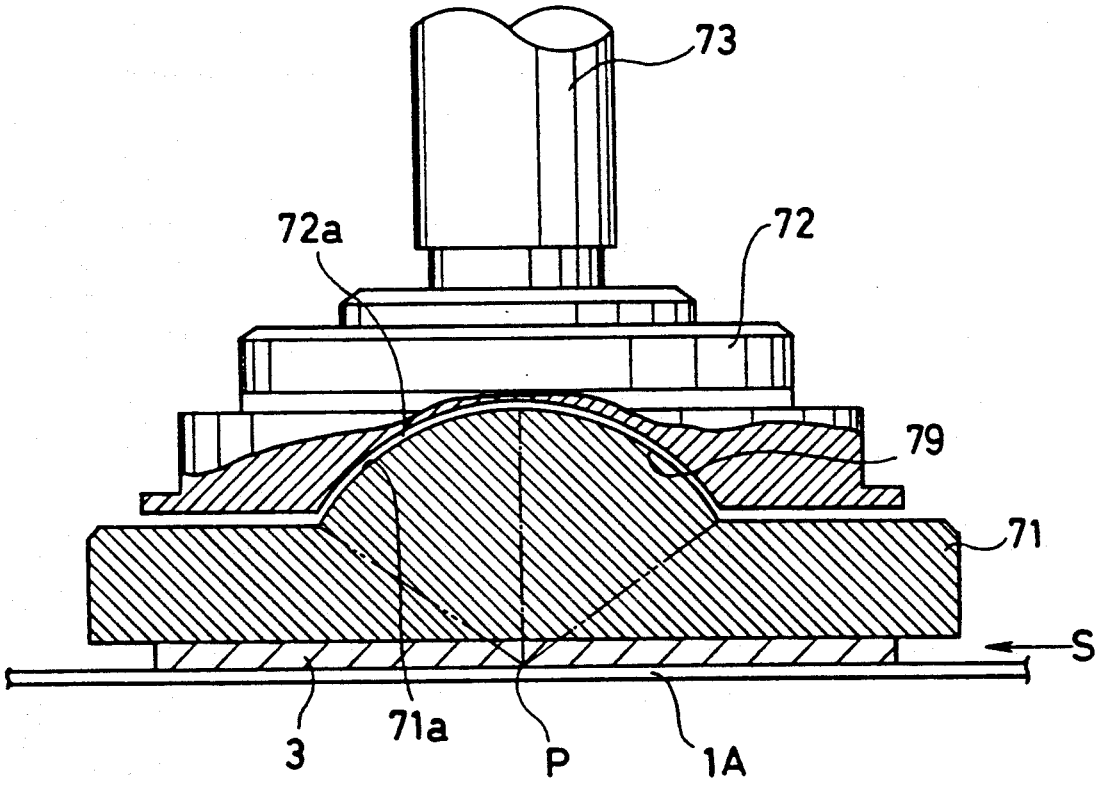
FIG. 7 PRIOR ART
FIG. 7 is a front cross-sectional view illustrating prior art.
Figure 8A:
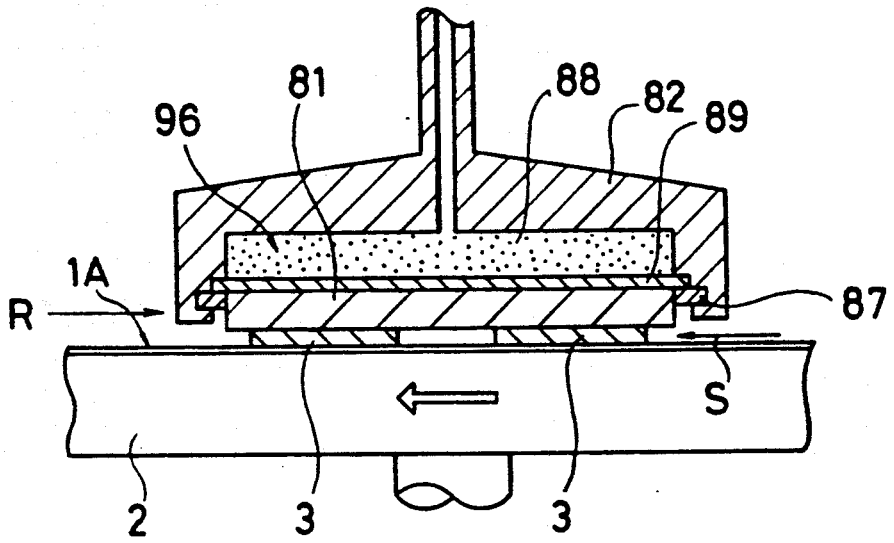
FIG.8(A) PRIOR ART
FIGS. 8A and 8B are a front cross-sectional view and an operational diagram illustrating prior art.
Figure 8B:
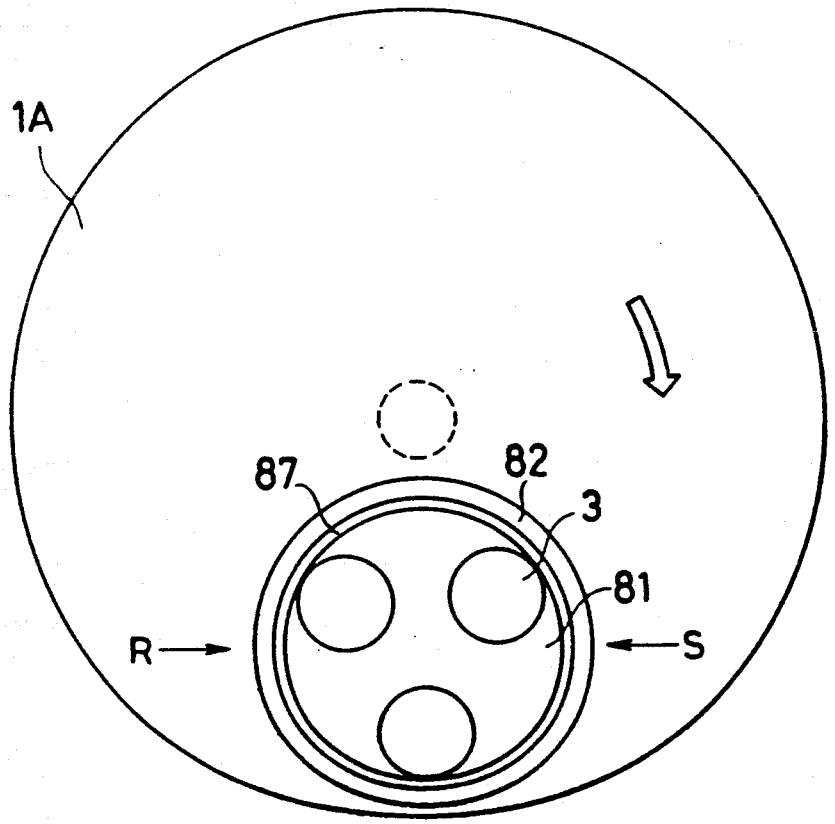
FIG.8(B) PRIOR ART
Figure 9:
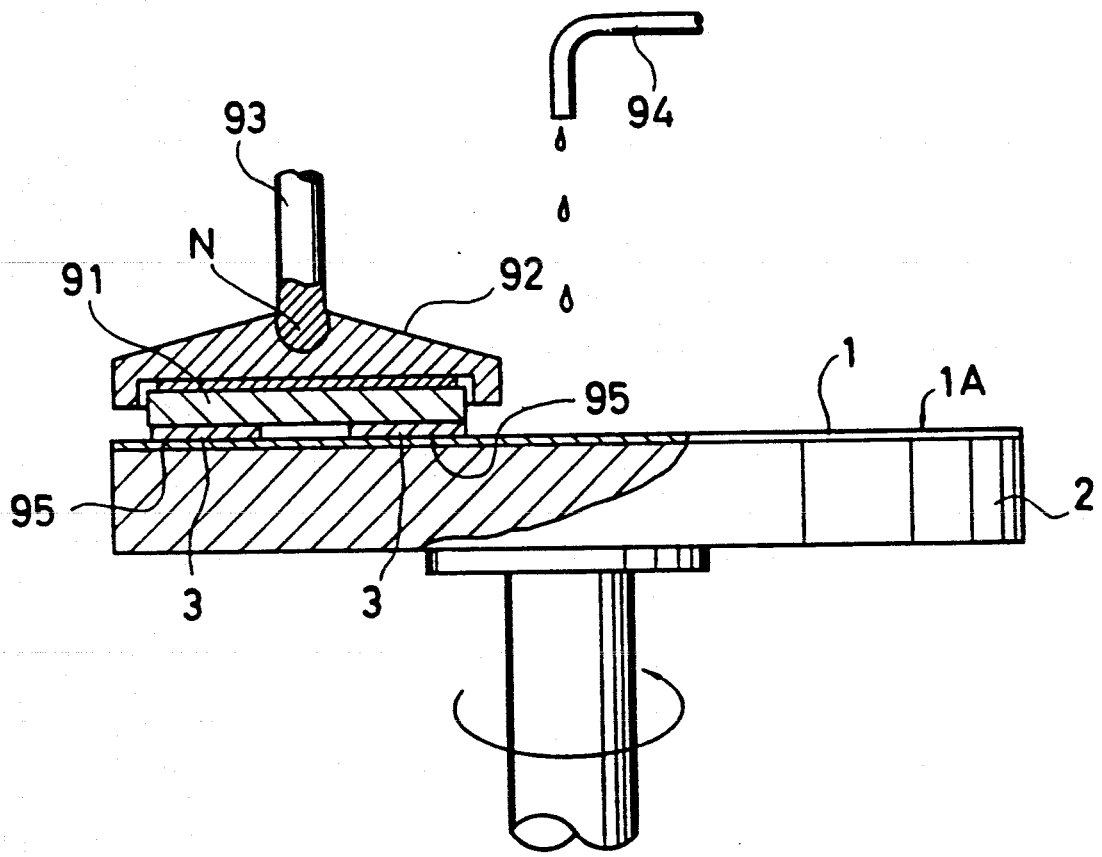
FIG. 9 PRIOR ART
FIG. 9 is a front cross-sectional view illustrating prior art.

FIGS. 6(A) and 6(B) illustrate an embodiment of the second invention which is designed to overcome the above problem. This apparatus comprises three plates 51 (the invention is not limited to this number) each having one thin semiconductor disk 3 secured to the underside, one large-diameter, disk-shaped support member 56 having circular holes 56*a* each larger than the associated plate 51, a cylindrical cap-shaped head section 52 (FIG. 6A) having the same diameter as the outer diameter of the support member 56 and secured to the top peripheral portion of the support member 56, and a plurality of ring-shaped thin sheets 54 for connecting the support member 56 to the individual plates 51.

The head section 52 has a rotational shaft 53 projecting from the top center thereof (FIG. 6A). A center hole 16 is bored in the rotational shaft 53 so that air pressure controlled to a predetermined level can be introduced through the hole 16.

The circular holes 56*a* of the support member 56 are arranged in such a way that their centers are positioned at equal angles of 120° on the same circumference around the rotational shaft 53, and the thin members 54, which are non-shrinkable and flexible, are continually connected between the inner wall of each circular hole 56*a* and the outer wall of the associated plate 51, whereby the inner space of the head section 52 located above this structure is sealed airtight. The attaching positions of the thin members 54 are so set that the intersecting point P of the imaginary extension lines of their cross sections lies on the polishing surface 1A of the thin semiconductor plate 3, as per the previously described embodiments.

According to this embodiment, even when the head section 52 is caused to make a frictional movement with respect to the polishing surface 1A, the positions of the individual plates 51 are independently changed in accordance with the movement and the thin members 54 for supporting the plates 51 restrict the positions of the plates 51 only in their respective sliding directions. as already described above in the "SUMMARY OF THE INVENTION". Accordingly, the operation and the effects of the present invention can be smoothly achieved.

As described above, the polishing surface according to the first invention is designed to be able to polish a thin plate while maintaining the plate untilted, and if slight surface displacement occurs when the surface table rotates, the positional correction can easily be done and the plate can be movable in accordance with the movement of the polishing surface. This can achieve the polishing of a thin semiconductor disk at a high flatness.

The polishing surface according to the second invention is designed so that it can polish a plurality of thin plates, and even if there is a change in thickness of the individual thin plates, a polishing work can be executed while maintaining a high parallelism between the plate and the polishing surface irrespective of said change.

What is claimed is:

1. A polishing apparatus for polishing a surface of an object to be polished using a relative frictional movement between said object and a polishing cloth, said apparatus comprising:

a plate having substantially flat top and bottom surfaces and a side surface and having at least one object to be polished secured to the bottom surface;

a head section surrounding said plate with a predetermined gap therebetween;

fluid pressure applying means, disposed in an inner space of said head section, for applying fluid pressure to the substantially flat top surface of said plate; and holding means comprising a flexible member and having an outer peripheral edge attached to an inner wall surface of said head section and an inner peripheral edge attached to the side surface of said plate and being disposed in said inner space and movable in a pressure applying direction, for holding said at least one object secured to the substantially flat bottom surface of said plate in coincidence with the surface of the polishing cloth, the attaching position of said holding means on the side surface of said plate being set substantially at the same height as or at a point lower than the attaching position of said holding means on the inner wall surface of said head section, said holding means being disposed to surround an entire periphery of said plate and being attached at specific intervals to radially symmetrical positions at the periphery of said plate, and an apex of an imaginary cone including said holding means or an intersecting point formed by imaginary lines extending from said attaching positions of said holding means on said head section and said plate substantially lying on or at a point lower than a polishing surface of said object to be polished.

2. A polishing apparatus according to claim 1, wherein said holding means is formed of an essentially non-shrinkable but still flexible member in the shape of any one of a film and thread.

3. A polishing apparatus according to claim 1, said pressure applying means comprising means for applying a load or pressure uniformly over the top surface of said plate or at a load center of said plate.

4. A polishing apparatus according to claim 1, said pressure applying means and said holding means comprising a housing having an opening at one end for surrounding said plate and a longitudinal bore at another end for receiving hydraulic pressure.

5. A polishing apparatus for polishing a surface of an object using a relative frictional movement between said object and a polishing cloth, said apparatus comprising:

a plurality of plates each having substantially flat top and bottom surfaces and a side surface and each having at least one object to be polished, respectively, secured to its substantially flat bottom surface;

a support member surrounding said plurality of plates by way of respective predetermined gaps therebetween; and a plurality of holding means each one being comprised of essentially a non-shrinkable and flexible member and having an outer peripheral edge connected to said support member and an inner peripheral edge connected to the side surface of a respective one of said plurality of plates and being provided for maintaining said at least one object parallel to the surface of the polishing cloth;

wherein an intersecting point P, formed by extension of imaginary lines along the cross section of opposite sides of said holding means, being defined by the following equation:

$$D=(A/B)d$$

wherein: A is the horizontal distance between the intersecting point P and the attaching position of said holding means to said plate; B is the horizontal distance between the attaching positions of said holding means to said plate and to said head section; D is the vertical distance between the intersecting point P and the attaching position of said holding means to said plate; and d is the vertical distance between the vertically staggered attaching positions of said holding means to said plate and to said head section.

6. A polishing apparatus according to claim 5, further comprising fluid pressure applying means for applying fluid pressure, toward said at least one object to be polished from the substantially flat top surfaces of said plurality of plates, in a gas-tight space, and wherein respective attaching positions of each of said flexible members on an outer surface of respective ones of said plurality of plates being set substantially at the same height as or at a position lower than attaching positions of respective ones of said flexible members on an inner surface of said support member.

7. A polishing apparatus according to claim 1, said fluid pressure applying means comprising pressure applying means having a gastight space inside said head section with a pressure adjusting mechanism communicating with the gastight space.

8. A polishing apparatus according to claim 1, said fluid pressure applying means comprising a combination of the fluid pressure and an adjustable weight disposed on the top surface of said plate.

9. A polishing apparatus for polishing a surface of an object to be polished using a relative frictional movement between said object and a polishing cloth, said apparatus comprising:

a plate having substantially flat top and bottom surfaces and a side surface and having at least one object to be polished secured to the bottom surface;

a head section surrounding said plate with a predetermined gap therebetween;

fluid pressure applying means, disposed in an inner space of said head section, for applying fluid pressure to the substantially flat top surface of said plate; and holding means comprising a flexible member and having an outer peripheral edge attached to an inner wall surface of said head section and an inner peripheral edge attached to the substantially flat top surface of said plate and being disposed in said inner space and movable in a pressure applying direction, for holding said at least one object secured to the substantially flat bottom surface of said plate in coincidence with the surface of the polishing cloth, the attaching position of said holding means on the side surface of said plate being set substantially at the same height as or at a point lower than the attaching position of said holding means on the inner wall surface of said head section;

wherein an intersecting point P, formed by extension of imaginary lines along the cross section of opposite sides of said holding means, being defined by the following equation:

$$D=(A/B)d$$

wherein: A is the horizontal distance between the intersecting point P and the attaching position of said holding means to said plate; B is the horizontal distance between the attaching positions of said holding means to said plate and to said head section; D is the vertical distance between the intersecting point P and the attaching position of said holding means to said plate; and d is the vertical distance between the vertically staggered attaching positions of said holding means to said plate and to said head section.

10. A polishing apparatus according to claim 1, wherein an intersecting point P, formed by extension of imaginary lines along the cross section of opposite sides of said holding means, being defined by the following equation:

$$D=(A/B)d$$

wherein: A is the horizontal distance between the intersecting point P and the attaching position of said holding means to said plate; B is the horizontal distance between the attaching positions of said holding means to said plate and to said head section; D is the vertical distance between the intersecting point P and the attaching position of said holding means to said plate; and d is the vertical distance between the vertically staggered attaching positions of said holding means to said plate and to said head section.

* * * * *